US007076809B2

(12) United States Patent
Rothman

(10) Patent No.: US 7,076,809 B2
(45) **Date of Patent: *Jul. 18, 2006**

(54) STRETCHABLE NURSING TANK TOP WITH INVISIBLE BREAST SUPPORT

(76) Inventor: Line Rothman, 2 Laurel St., Rye, NY (US) 10580

( * ) Notice: Subject to any disclaimer, the term of this patent is extended or adjusted under 35 U.S.C. 154(b) by 0 days.

This patent is subject to a terminal disclaimer.

(21) Appl. No.: 11/050,404

(22) Filed: Feb. 3, 2005

(65) Prior Publication Data

US 2005/0208873 A1 Sep. 22, 2005

Related U.S. Application Data

(63) Continuation of application No. 10/398,433, filed as application No. PCT/US01/30818 on Oct. 3, 2001, now Pat. No. 6,855,029.

(60) Provisional application No. 60/238,602, filed on Oct. 6, 2000.

(51) Int. Cl.
*A41C 3/00* (2006.01)
*A41D 1/20* (2006.01)

(52) U.S. Cl. ..... 2/104; 2/69; 2/106; 450/36

(58) Field of Classification Search ..... 2/69, 2/104–106, 73, 78.1–78.4, 113–115, 119–121, 2/80, 83, 79, 108–110, 85, 94, 96, 95; 450/36, 450/37, 30–32, 34, 35, 7–16
See application file for complete search history.

(56) References Cited

U.S. PATENT DOCUMENTS 3,176,692 A * 4/1965 Marino ..... 450/30
4,440,174 A * 4/1984 Cordova ..... 450/31
4,564,015 A * 1/1986 Friedman ..... 450/31
4,648,404 A * 3/1987 Clark ..... 450/31
6,282,719 B1 * 9/2001 Vera et al. ..... 2/78.1
6,346,027 B1 * 2/2002 Merkovsky ..... 450/37
6,443,805 B1 * 9/2002 Kirkwood ..... 450/31
6,645,041 B1 * 11/2003 Sorensen ..... 450/36
6,855,029 B1 * 2/2005 Rothman ..... 450/36

* cited by examiner

*Primary Examiner*—Gloria M. Hale
(74) *Attorney, Agent, or Firm*—Allan Jacobson

(57) ABSTRACT

A form fitting nursing tank top/undershirt made with a stretch fabric includes an invisible built in nursing bra. The invisible nursing bra is partly internal and partly external. The external portion of the built in nursing bra is the left and right shoulder straps, which from outside appearances form an integral part of the tank top/undershirt. The internal portion of the built in nursing bra is formed by a soft cup frame attached at the bottom to an elastic chest band and attached at the top to the front of the shoulder straps. In the back of the garment, the elastic chest band is attached to an internal back piece of fabric on the inside of the tank top. The internal back piece of fabric extends upward from the elastic chest band to the shoulder straps at the back, which shoulder straps each include an adjustable length section. Internal nursing flaps are attached at the bottom to the soft cup frame and at the top to the tank top body which forms external nursing flaps. The tank top/undershirt includes a continuous stretch body extending upward from the torso and forming the external nursing flaps which are attached to the internal nursing flaps and to the shoulder straps, to give a smooth single piece garment appearance.

18 Claims, 2 Drawing Sheets

STRETCHABLE NURSING TANK TOP WITH INVISIBLE BREAST SUPPORT

This is a continuation of U.S. application Ser. No. 10/398,433, filed Jun. 30, 2003, now U.S. Pat. No. 6,855,029, which is a national phase patent application based on International patent application PCT/US01/30818, with an international filing date of Oct. 3, 2001 designating the United States of America, which claims priority from U.S. provisional patent application Ser. No. 60/238,602, filed Oct. 6, 2000.

FIELD OF THE INVENTION

The present invention relates to clothing for nursing mothers.

BACKGROUND OF THE INVENTION

A nursing bra typically includes features that permit a nursing mother to conveniently and comfortably access the breast in order to breast feed her baby.

For example, U.S. Pat. No. 6,083,079 shows a brassiere with a folding cup which is released by opening a closure at the top of the cup and folding the cup downward to access the breast. Another example is shown in U.S. Pat. No. 4,878,879 in which a specialized closure device fastens a folding cup to a nursing bra. All nursing brassieres are worn beneath an outer garment, which also must be moved aside to gain access to the folding cup of the nursing bra. U.S. Pat. No. 4,648,404 shows pair of separate but coordinated nursing undergarments, i.e., a complete bra and a complete slip that work together. An outer garment is still required. Specialized nursing clothing used as outer garments have odd-looking slits and openings and are typically available in enormous sizes.

U.S. Pat. No. 5,461,725 is typical of a specialized outer garment intended for a nursing mother. While nursing garment provides access to the mother's breast for feeding purposes, the garment fails to provide the important breast support needed by a nursing mother. As a consequence, nursing bras are often still required to be worn underneath the typical nursing outer garment.

Yet, for economy, flexibility and style, many women would prefer to wear normal everyday clothing with a nursing bra underneath. However, many common articles of clothing such as a woman's shirt or top are awkward to use with a typical nursing bra. For example, unbuttoning a blouse in public or semi-public settings is an awkward movement. Indecorous motions that attract attention often accompany accessing the nursing undergarment through regular clothing. As another example, lifting a shirt or sweater at the bottom edge of the garment to reach the nursing bra awkwardly exposes skin in the midsection or stomach area.

SUMMARY OF THE INVENTION

The invention is embodied in a tank top/undershirt with invisible breast support for nursing mothers. In particular, a form fitting stretch fabric tank top/undershirt includes left and right external fabric nursing flaps (breast covers), which attach and release to respective left and right shoulder straps just above the breast. The tank top/undershirt includes a built in nursing bra that is partly internal and partly external.

The external portion of the built in nursing bra is the left and right shoulder straps, which from outside appearances are an integral part of the tank top/undershirt. Thus, the tank top/undershirt looks smooth on the outside with no outer cups. Only the exteriors of fasteners are visible, and some hidden types of fasteners are nearly impossible to detect.

The tank top/undershirt of the present invention is a complete connected unit so that during nursing there is no loose shoulder strap to get lost underneath other layers of clothing. When lifting any outer garment shirt of any style by its bottom edge, the tank top/undershirt of the present invention keeps the stomach covered while the mother opens and closes the nursing flaps. The nursing flaps conveniently detach and fold down underneath the outer clothing. The built in bra mechanism gives full breast support and the stretchable material lets the tank top/undershirt shrink to match the weight loss typical after the birth of the baby. The elastic stretch fabric body of the tank top/undershirt also provides firm stomach support.

A nursing mother can maintain her own style without having to wear nursing clothes with odd-looking slits and openings, in enormous sizes. The invented garment may be worn as a tank top by itself, or worn underneath regular clothing. The present invented garment provides for absolute discretion, easy access for the baby to nurse, with no awkward movements to adjust shoulder straps, and with the maximum important support that is needed for the breasts and the body.

DETAILED DESCRIPTION

Figure 1:
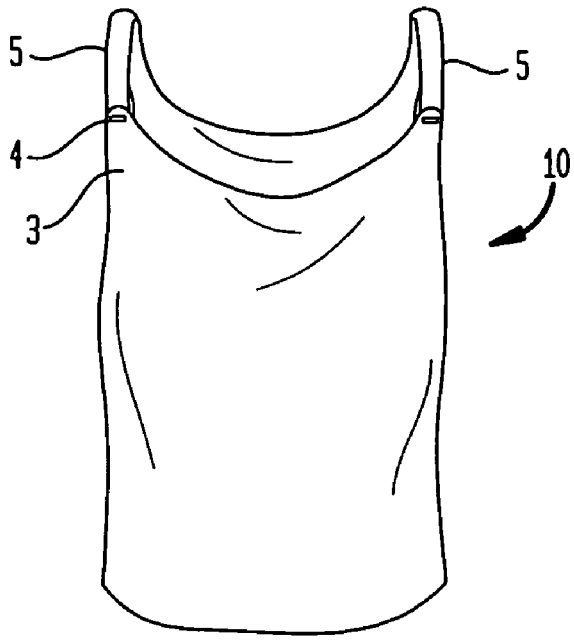
FIG. 1 is an external front view with nursing flaps closed of a nursing tank top/undershirt in accordance with the present invention.
Figure 2:
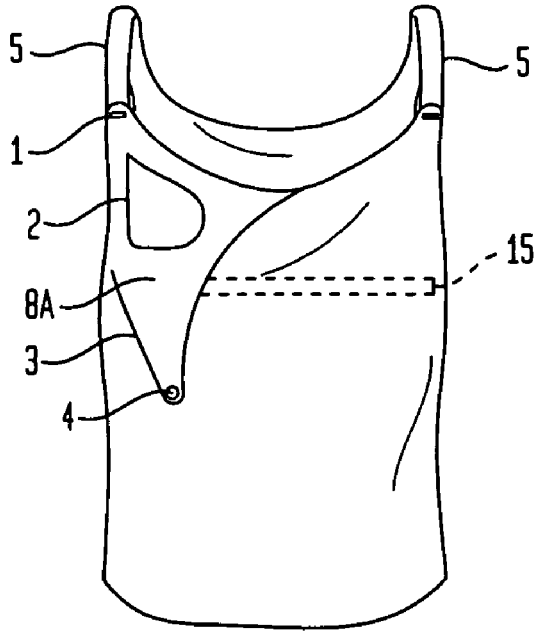
FIG. 2 is an external front view with one nursing flap open of a nursing tank top/undershirt in accordance with the present invention.

The front view of the nursing tank top/undershirt 10 shown in FIG. 1 includes external nursing flaps 3, which fasten 4 to shoulder straps 5. In FIG. 2, the external nursing flap 3 is shown in an open position, revealing a soft cup breast support 2, an inner fastener 1 and an internal nursing flap 8A. When the external nursing flap 3 and internal nursing flap 8A are closed, the inner fastener 1 couples with the outer fastener 4. An internal elastic chest band 15 is positioned just below the soft cup breast support 2.

Figure 3:
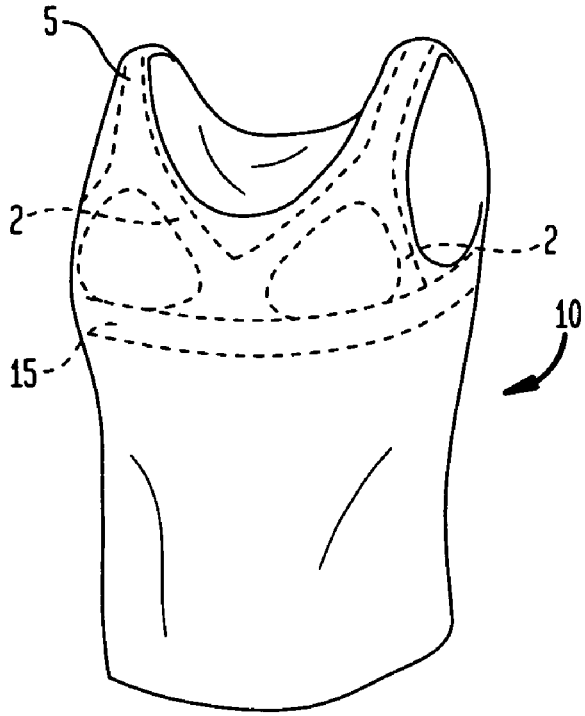
FIG. 3 is an isometric view of a nursing tank top/undershirt with the internal construction details shown in phantom in accordance with the present invention.

FIG. 3 illustrates the built in nursing bra hidden inside the tank top/undershirt 10. The internal elastic chest band 15 is attached to the soft cup frame 2, which is in turn attached to the shoulder straps 5.

Figure 4:
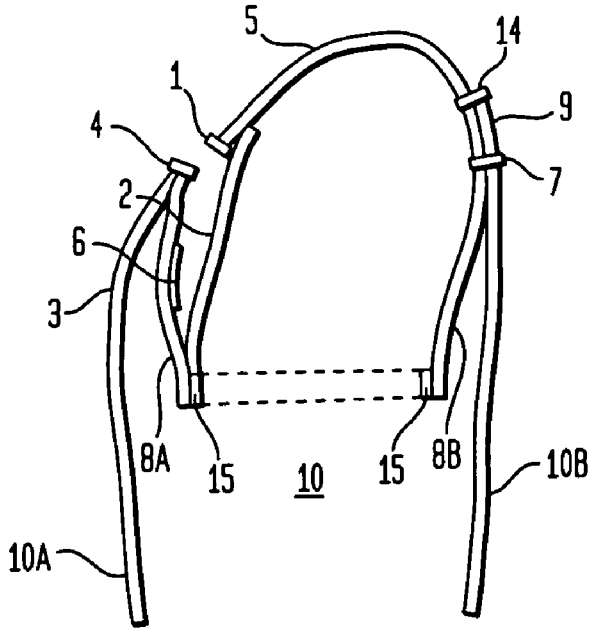
FIG. 4 is a cross sectional side view of a nursing tank top/undershirt in accordance with the present invention.

As indicated, the tank top/undershirt 10 of the present invention includes a built in nursing bra that is partly internal and partly external. More specifically, in FIG. 4, a built in nursing bra is formed by a soft cup frame 2 attached at the bottom to an elastic chest band 15 and attached via short straps at the top to the front of the shoulder straps 5. In the back, the elastic chest band 15 is attached to an internal back piece of fabric 8B on the inside of the tank top 10. The internal back piece of fabric 8B extends upward from the elastic chest band 15 to the shoulder straps 5 at the back. The shoulder straps 5 include an adjustable section 9 shown in schematic form. Adjustment devices 7, 14 are provided for adjusting the length of one section 9 of the shoulder strap 5.

Internal nursing flaps 8A are attached to the bottom of the soft cup frame 2. When closed, the internal nursing flaps 8A directly cover the breasts and are attached to the shoulder straps 5 at the top of the soft cup frame 2. The internal nursing flap 8A may include a provision for placement of a nursing pad 6. External nursing flaps 3 are attached to the internal nursing flaps 8A at the top of both nursing flaps, where a fastener 4 is located. Both internal and external nursing flaps 8A, 3 cover the breasts when fastener 4 is coupled to the shoulder straps 5 by fastener 1 at the top of the soft cup frame 2. The nursing flap fasteners 1 and 4 are shown in schematic form to represent any type of fastener. Preferably, the fasteners 1, 4 should be of a hidden type so that the external nursing flap 3 and the shoulder strap 5 appear to be one continuous garment.

The outer garment of the tank top/undershirt includes a stretch body wrap 10A, 10B extending upward from the torso and forming the external nursing flaps 3 which are attached to the internal nursing flaps 8A and to the shoulder straps 5 to give a smooth single garment appearance. The front 10A and back 10B (i.e., the body wrap portion) of the tank top/undershirt 10 is made of an elastic, stretchable fabric so as to form fit around the torso of the wearer.

The concealed internal nursing bra is formed partly by internal components and partly by external components. In particular, the tank top/undershirt 10 of the present invention has a built in invisible nursing bra formed by internal sections comprising the elastic chest band 15, the soft cup frame 2, the internal nursing flaps 8A, and the back piece of fabric 8B. For additional support, nursing flaps 8A and the back piece of fabric 8B may alternatively be constructed using one piece of fabric extending around the torso, in the same manner that the elastic chest band extends around the torso. The shoulder straps 5 including the adjustable section 9 form the external portion of the invisible nursing bra. Externally, the shoulder straps 5 appear to be part of the tank top/undershirt and do not appear to be part of a nursing bra.

In use, the wearer adjusts the length 9 of the straps 5 of the tank top 10 for snug fit. The internal and external nursing flaps 8A, 3 cover the soft cup frame 2 when the fasteners 1, 4 are closed. The internal fabric flaps 8A can also have a pocket made of netting or of the same fabric material as the tank top to hold a nursing pad 6 in its place. Fasteners 1 and 4 may be snaps, clasps or a hook and loop type fastener, in order to hold the internal and external fabric flaps 8A, 3, which cover the breasts and the soft cup frame 2. To nurse the baby, fasteners 1 and 4 are separated, and both internal and external nursing flaps 8A, 3 fold downward to access the breast. After feeding, the internal and external nursing flaps 8A, 3 are re-attached to the shoulder straps 5 by fasteners 1 and 4.

What is claimed is:

1. In a nursing garment having a nursing bra arrangement comprising a nursing soft cup breast support having a base and a top, a nursing flap having a base and a top, said base thereof attached to said base of said nursing soft cup breast support, a first fastener attached to the top of said nursing flap, and a second fastener attached to the top of said nursing soft cup breast support, said first and second fasteners adapted to fasten the top of said nursing flap to the top of said nursing soft cup breast support, the improvement comprising:

an elastic chest band having a front section and a back section;

said nursing soft cup breast support attached at said base thereof to said front section of said elastic chest band, a fabric body with a front and a back, the top of said front of said fabric body attached to the top of said nursing flap;

a shoulder strap baying a front end and a back end, the front end thereof connected to said second fastener and the back end thereof connected to the top of the back of the fabric body; and said back section of said elastic chest band being coupled to said backend of said shoulder strap.

2. A nursing garment in accordance with claim 1, wherein said back section of said elastic chest band is coupled to said backend of said shoulder strap via a back piece of fabric.

3. A nursing garment in accordance with claim 2, wherein said back piece and the nursing flap are one continuous piece of fabric.

4. A nursing garment in accordance with claim 1, wherein said shoulder strap includes an adjustable length portion therein.

5. A nursing garment in accordance with claim 2, wherein the top edge of said back piece is coupled to the back end of the shoulder strap via an adjustable length section.

6. A nursing garment comprising:

a nursing soft cup breast support having a base and a top, an internal nursing flap having a base and a top, said base thereof attached to said base of said nursing soft cup breast support;

a first fastener attached to the top of said internal nursing flap;

a second fastener attached to the top of said nursing soft cup breast support, said first and second fasteners adapted to fasten the top of said internal nursing flap to the top of said nursing soft cup breast support;

a fabric body with a front and a back, the top of said front of said fabric body attached to the top of said internal nursing flap so as to form an external nursing flap;

an elastic chest band, having a front section and a back section, said nursing soft cup breast support attached at said base thereof to said front section of said elastic chest band; and a shoulder strap having a front end and a back region, the front end the shoulder strap connected to said second fastener attached to the top of said nursing soft cup breast support, the back region of the shoulder strap being connected to the top of the back of the fabric body, and the back region of said shoulder strap also being coupled to said back section of said elastic chest band.

7. A nursing garment in accordance with claim 6, wherein said shoulder strap is coupled to said back section of said elastic chest band via a back piece of fabric.

8. A nursing garment in accordance with claim 7, wherein said back piece and said internal nursing flap are one continuous piece of fabric.

9. A nursing garment in accordance with claim 6, wherein the shoulder strap includes an adjustable length portion therein.

10. A nursing garment in accordance with claim 7, wherein the top edge of the back piece is coupled to the back end of the shoulder strap via an adjustable length section.

11. A nursing garment comprising:

a nursing bra including a shoulder strap having a front region and a back region, an elastic chest band having a front section and a back section, said back region of said shoulder strap being coupled to said back section of section of said elastic chest band, a nursing soft cup breast support having a base and a top, said nursing soft cup breast support attached at said base thereof to said front section of said elastic chest band and attached at the top thereof to said front region of said shoulder strap, an internal nursing flap having a base and a top, said base thereof attached to said base of said nursing soft cup breast support, a first fastener attached to said top of said internal nursing flap, and a second fastener attached to the front region of said shoulder strap, said first fastener adapted to fasten said top of said internal nursing flap to said second fastener; and a fabric body having a top front edge and a rear top edge, said top front edge attached to said top of said internal nursing flap and said rear top edge attached to said back region of said shoulder strap.

12. A nursing garment in accordance with claim 11, wherein said back region of said shoulder strap is coupled to said back section of said elastic chest band by a back piece having a base edge and a top edge, said base edge of said back piece being attached to said back section of said elastic band, and said top edge of said back piece being attached to said back region of said shoulder strap.

13. A nursing garment in accordance with claim 12, wherein said rear top edge of said fabric body is attached to said back region of said shoulder strap by attachment thereof to said top edge of said back piece.

14. A nursing garment in accordance with claim 12, wherein said top edge of said back piece is attached to said back section of said shoulder strap via an adjustable length section.

15. A nursing garment in accordance with claim 12, wherein said back piece back and internal nursing flap are one continuous piece of fabric.

16. A nursing garment in accordance with claim 11, wherein said fabric body is elastic stretch fabric.

17. A nursing garment in accordance with claim 11, wherein said shoulder strap includes an adjustable length portion therein.

18. A nursing garment in accordance with claim 11, wherein said nursing soft cup breast support is a soft cup frame.

* * * * *